United States Patent [19]

Shimizu

[11] Patent Number: 4,747,718

[45] Date of Patent: May 31, 1988

[54] AUTOMATIC CUT-SHEET FEEDER FOR PRINTERS

[75] Inventor: Makoto Shimizu, Tokyo, Japan

[73] Assignee: Oki Electric Industry Co., Ltd., Tokyo, Japan

[21] Appl. No.: 6,541

[22] Filed: Jan. 9, 1987

Related U.S. Application Data

[63] Continuation of Ser. No. 719,142, Apr. 2, 1985, abandoned.

[30] Foreign Application Priority Data

Apr. 5, 1984 [JP] Japan ..... 59-66669

[51] Int. Cl.[4] ..... B41J 11/58

[52] U.S. Cl. ..... 400/625; 400/208; 400/645.1

[58] Field of Search ..... 400/175, 208, 596, 603, 400/604, 642, 624, 645, 625, 628, 645.1, 629, 645.5

[56] References Cited

U.S. PATENT DOCUMENTS

| | | | |
|---|---|---|---|
| 2,227,643 | 1/1941 | Hageman | 400/629 |
| 4,289,412 | 9/1981 | Dollenmayer | 400/175 X |
| 4,326,815 | 4/1982 | Kapp | 400/625 |
| 4,339,210 | 7/1982 | Craft et al. | 400/208 |
| 4,341,480 | 7/1982 | Mailer | 400/625 |
| 4,388,008 | 6/1983 | Greene et al. | 400/625 X |
| 4,396,307 | 8/1983 | Shah et al. | 400/625 |
| 4,438,915 | 3/1984 | Akamatsu et al. | 271/9 |
| 4,569,611 | 2/1986 | Watanabe et al. | 400/624 |

*Primary Examiner*—Charles Pearson

*Attorney, Agent, or Firm*—Wenderoth, Lind & Ponack

[57] ABSTRACT

An automatic cut-sheet feeder incorporated in a printer includes an upper sheet guide having an ink ribbon replacement recess defining a clearance between the upper sheet guide and a print head of the printer for thereby allowing an ink ribbon cassette to be replaced with ease. When a cut sheet is fed to the front side of a platen, the print head mounted on a carriage is controlled to move to a position corresponding to the ink ribbon replacement recess in the upper sheet guide. The printed cut sheet can smoothly be discharged by the upper sheet guide into a stacker. The ink ribbon cassette on the print head can easily be replaced with a new one.

8 Claims, 4 Drawing Sheets

AUTOMATIC CUT-SHEET FEEDER FOR PRINTERS

This application is a continuation, of now abandoned application Ser. No. 719,142, filed Apr. 2, 1985, now abandoned.

BACKGROUND OF THE INVENTION

The present invention relates to an automatic cut-sheet feeder for use with a printer.

Automatic cut-sheet feeders are combined with printers for allowing the printers to print separate sheets successively. More specifically, the automatic cut-sheet feeder operates to supply separate sheets automatically to the printer and discharge printed sheets from the printer.

The automatic cut-sheet feeder is composed of a hopper for extracting one cut sheet at a time from a sheet stack, a feed guide for guiding the extracted cut sheet to a platen in the printer, and a stacker for discharging and stacking cut sheets printed by the printer.

The cut sheets are automatically delivered one at a time from the hopper in response to a feed-in command signal. The cut sheet thus delivered passes through the feed guide and is turned around the platen from a position rearward and downward of the platen toward a position forward of the platen. After the cut sheet has been printed by a print head of the printer, it is delivered from a position forward and upward of the platen toward the stacker of the automatic cut-sheet feeder.

The print head is positioned in front of the platen for printing the cut sheet when it is disposed around the platen across the front surface thereof.

With the conventional cut-sheet feeder, the leading end of the cut sheet as it is turned around the platen is separated from the platen in a front region of the platen, i.e., a region where the print head is moved.

According to one proposal disclosed in U.S. Pat. No. 4,396,307, the cut sheet is pressed against the platen by pressure rollers, which are required to be moved off the platen when the leading end of the cut sheet reaches the pressure rollers, thus providing a clearance allowing the cut sheet to pass therethrough. The pressure rollers are moved in the opening and closing directions by an electromagnet and a link mechanism, which are mechanically and electrically coupled to the printer through a complex arrangement.

U.S. Pat. No. 4,438,915 discloses guide plates 26, 26' disposed in prescribed positions. With this prior arrangement, however, where a cut sheet of a different width or a greater width is used, the leading end of the cut sheet tends to be caught in an area where the guide plates are not present, with the result that the cut sheet may not be fed into the stacker of the cut-sheet feeder.

To eliminate the above drawback, the prior cut-sheet feeder has an upper sheet guide for guiding the leading end of the cut sheet. The upper sheet guide has a width equal to or larger than the width of the cut sheet so as to cover the platen thereabove. The printed cut sheet can be delivered through the upper sheet guide toward the stacker.

Since the upper sheet guide serves to guide the leading end of the cut sheet, it is positioned very closely to the platen. Inasmuch as the print head is also located closely to the platen, the upper sheet guide and the print head are positioned closely to each other. Such a positional arrangement is problematic since the upper sheet guide becomes an obstacle to the replacement of an ink ribbon cassette on the print head, and hence the ink ribbon cassette cannot be replaced with a new one highly efficiently.

SUMMARY OF THE INVENTION

It is an object of the present invention to provide an improved automatic cut-sheet feeder.

Another object of the present invention is to provide an automatic cut-sheet feeder of a more reliable design capable of discharging cut sheets printed by a printer to a stacker without fail.

Still another object of the present invention is to provide an automatic cut-sheet feeder which allows an ink ribbon cassette to be replaced easily and efficiently in the printer.

A still further object of the present invention is to provide an automatic cut-sheet feeder having an improved upper sheet guide for enabling the same to perform its function thoroughly.

According to the present invention, an upper sheet guide disposed in covering relation to a platen over its upper and front portion has a recess defined therein to provide a clearance between itself and a print head so that an ink ribbon cassette can easily be replaced through the recess.

According to the present invention, furthermore, the print head mounted on a carriage has a front sheet guide, and the carriage is controlled in a character spacing direction to move the front sheet guide into a position confronting the recess in the sheet guide, thereby preventing the leading end of a cut sheet from separating from the platen. With this arrangement, the cut sheet can be fed properly to a stacker part without being caught by the ink ribbon replacement recess in the upper sheet guide.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
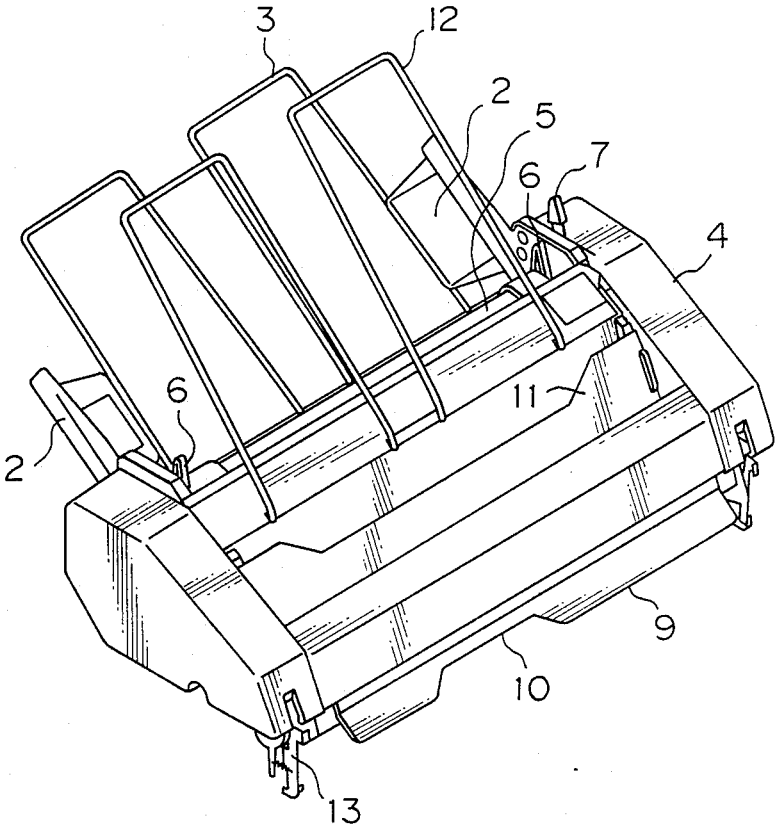
FIG. 1 is a perspective view of an automatic cut-sheet feeder according to the present invention.
Figure 2:
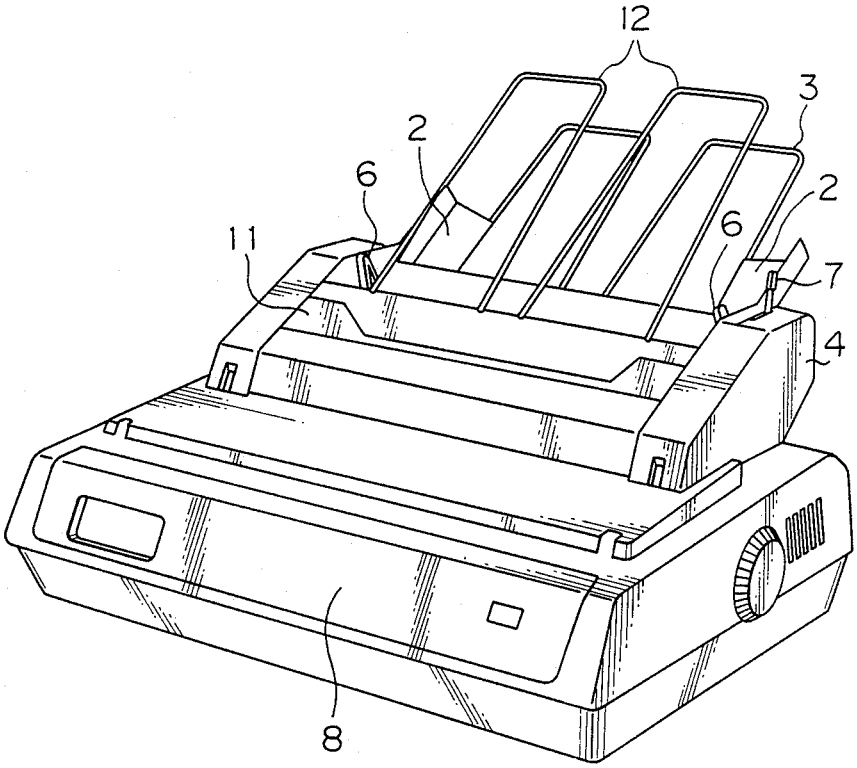
FIG. 2 is a perspective view of a printer with the automatic cut-sheet feeder of the invention being incorporated therein.
Figure 3:
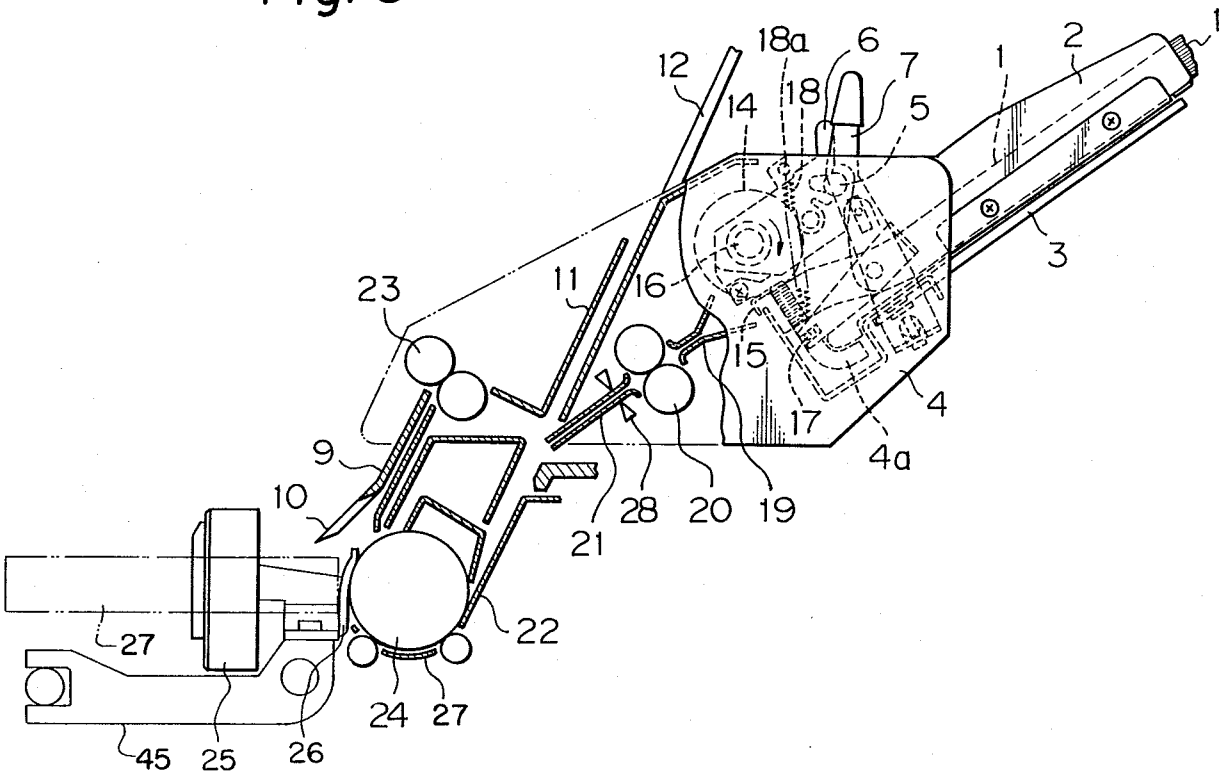
FIG. 3 is fragmentary side elevational view, partly in cross section, of the printer shown in FIG. 2.

As shown in FIGS. 1, 2 and 3, an automatic cut-sheet feeder according to the present invention includes a pair of laterally spaced sheet guides 2 each of an L-shaped cross section, for supporting a stack of cut sheets 1 thereon. The automatic cut-sheet feeder also includes U-shaped hopper sheet-support frames 3 for supporting a central portion of the cut sheets 1, a pair of side frames 4, and a guide shaft 5 extending between the side frames 4, the sheet guides 2 being supported on the guide shaft 5 for axial movement thereon to provide an axial sheet limiting space matching the width of the cut sheets 1.

Lock levers 6 are pressed against the guide shaft 5 for frictionally locking the sheet guides 2. A set lever serves to press the cut sheets 1 against a hopper roller 14, described later, for allowing the cut sheets 1 to be extracted one at a time easily from the sheet stack supported on the sheet guide 2. The automatic cut-sheet feeder is incorporated in a printer 8.

An upper sheet guide 9 is positioned upwardly of a platen 24 of the printer 8 for guiding printed cut sheets to a stacker, described later, the upper sheet guide 9 having a width equal to or greater than the width of the cut sheets 1. The upper sheet guide 9 has a recess 10 defined in a lower edge thereof just left of center with respect to its width and that of the platen so that the right edge of the recess is closer to the center of the platen than is the left edge, but the left edge is spaced from the left edge of the platen surface, for permitting an ink ribbon cassette 27 to be replaced easily through the recess 10. The recess 10 provides a clearance between the upper sheet guide 9 and a print head 25. The printed cut sheets 1 are accommodated in a stacker frame 11 to which re connected stacker sheet support frames 12. The automatic cut-sheet feeder is attached to the printer 8 by means of connectors 13.

As better shown in FIG. 3, the hopper roller 14 is mounted on a drive shaft 16 and driven thereby to rotate about its own axis for feeding the cut sheets 1 one at a time. A separator finger 15 serves to separate the cut sheets 1 one by one when they are fed out. The hopper roller 14 and the separator finger 15 are attached to a side of each of sheet guides 2 and movable laterally to meet the width of the cut sheets 1. A movable shaft 17 is positioned in the vicinity of the leading ends of the cut sheets 1 supported on the sheet guides 2. The movable shaft 17 is normally urged to move upwardly along a slot 4*a* by a presser spring 18 having an end 18*a* engaging one of the sheet guides 2.

The portion, indicated by the broken lines, of the side frame 4, the sheet guides 2, and the hopper sheet support frames 3 jointly constitute a hopper of the automatic cut-sheet feeder.

A feed guide assembly of the automatic cut-sheet feeder will be described below.

The feed guide assembly comprises a first feed guide 19, a first feed roller pair 20, and a second feed guide 21. The printer 8 includes a paper chute 22. The paper chute 22 and the feed guide assembly provide a feed path extending continuously from the hopper roller 14 to the platen 24 for feeding the cut sheets 1.

The stacker of the automatic cut-sheet feeder comprises the upper sheet guide 9, the stacker frame 11, the stacker sheet support frame 12, and a second feed roller pair 23 disposed above the upper sheet guide 9.

A printing mechanism of the printer will be described below. The platen 24 around which a cut sheet 1 is turned provides a printing surface. The print head 25 is disposed in confronting relation to the printing surface of the platen 24. A front sheet guide 26 is positioned in front of the platen 24. The print head 25, the front sheet guide 26, and the ink ribbon cassette 27 are mounted on a carriage 45 which is controlled by a controller to traverse the platen 24 in a character-spacing direction leftward and rightward between the opposite edge of the printing surface of the platen.

A sensor 28 is disposed on the second feed guide 21 for detecting the leading end of a cut sheet 1 as it is fed along through the feed path.

Figure 4:
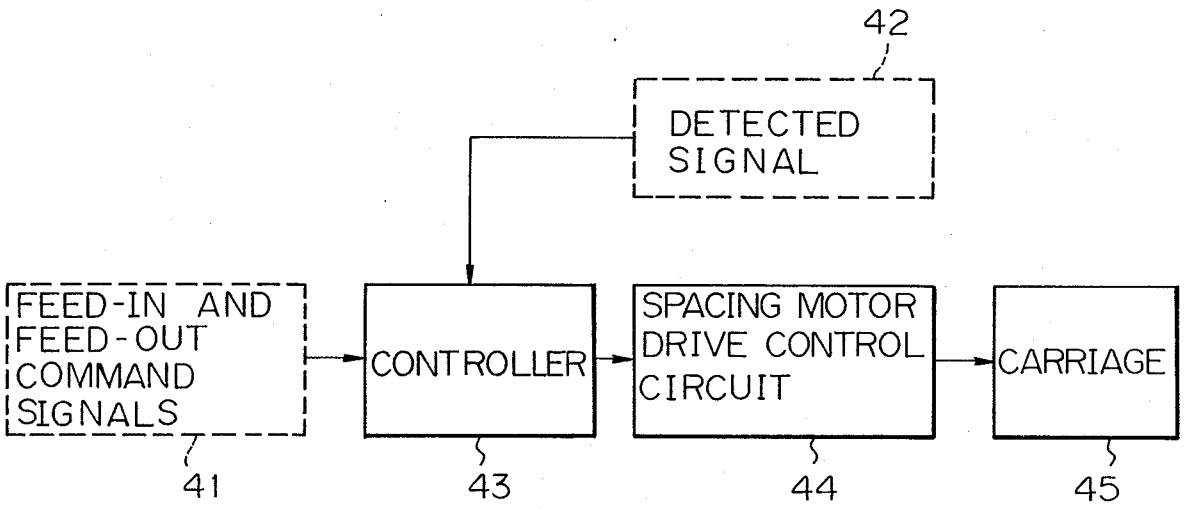
FIG. 4 is a block diagram showing a flow of operation of the automatic cut-sheet feeder according to the present invention.

Operation of the automatic cut-sheet feeder will be described with reference to FIG. 4 which shows an operation flow in a block form.

The stack of cut sheets 1 is placed on the sheet guides 2, and the front end thereof is urged by the movable shaft 17 upwardly against the hopper roller 14.

A feed-in command signal 41 is applied to engage a clutch (not shown) to rotate the drive shaft 16 for enabling the hopper roller 14 to feed the cut sheets 1 one at a time. The cut sheet 1 fed from the sheet stack goes through the first feed guide 19 to the first feed roller pair 20, by which the cut sheet 1 is fed along past the second guide 21. At this time, the leading end of the cut sheet 1 being fed along is detected by the sensor 28, which issues a detected signal 42 to the controller, denoted 43 in FIG. 4, to indicate that the cut sheet 1 is fed to the platen 24.

The controller 43 then applies a command signal to a spacing motor drive control circuit 44 for moving the carriage 45 to bring the front sheet guide 26 into a position confronting the ink ribbon replacement recess 10 in the upper sheet guide 9, before the leading end of the cut sheet 1 reaches the front side of the platen 24.

The cut sheet 1 is then turned around the platen 24 from a position therebelow to a position forward and upward of the platen 24. At this time, the leading end of the cut sheet 1 is pressed against the platen 24 by the front sheet guide 26 so as to be prevented from being separated from the front side of the platen 24 and also from being caught in the ink ribbon replacement recess 10.

The cut sheet 1 thus oriented in an advancing direction from the platen 24 is fed along as it is guided by the upper sheet guide 9 to reach the second feed roller pair 23. Then, the cut sheet 1 is discharged by the second feed roller pair 23 onto a stack of printed cut sheets supported by the stacker sheet support frames 12.

Desired characters or figures can be printed on the cut sheet 1 as it passed between the print head 25 and the platen 24, in the conventional manner.

Although a certain preferred embodiment has been shown and described, it should be understood that many changes and modifications may be made therein without departing from the scope of the appended claims.

What is claimed is:

1. An automatic cut-sheet feeder used with a printer, comprising:

(a) a hopper for supporting a stack of cut sheets to be printed;

(b) a stacker for supporting a stack of printed cut sheets;

(c) a platen extending in a longitudinal direction and providing a printing surface against which a cut sheet is fed by feeding the cut sheet from said hopper under and around said platen, said printing surface of said platen having a left platen surface edge and a right platen surface edge opposite said left platen surface edge;

(d) a feed path extending from said hopper to said platen for feeding the cut sheets therethrough;

(e) a sensor disposed along said feed path for detecting the cut sheet fed from said hopper;

(f) a print head mounted on a carriage movable in said longitudinal direction, the carriage having means for replaceably mounting an ink ribbon cartridge thereon, said print head being disposed in confronting relation to said printing surface so as to be reciprocally movable leftward toward said left platen surface edge and rightward toward said right platen surface edge when viewed in a direction from said print head toward said platen surface, for printing on the cut sheet disposed around said platen;

(g) an upper sheet guide disposed in close proximity to an upper portion of said platen for delivering the printed cut sheet into said stacker, said upper sheet guide having a width in said longitudinal direction, an ink ribbon cartridge replacement recess being provided in said upper sheet guide, said recess being sized to allow replacement of an ink ribbon cartridge on said carriage and said recess having a left recess edge and right recess edge when viewed in a direction from said print head toward said platen surface, said recess in said upper sheet guide being positioned in said longitudinal direction to the left of the center of said platen such that said right recess edge is closer to said center of said platen than said left recess edge and said left recess edge is positioned to the right of said left platen surface edge;

(h) a front sheet guide mounted on said carriage, said front sheet guide having a width in said longitudinal direction which is less than said width of said upper sheet guide and positioned facing said platen, the front sheet guide being movable together with said print head for preventing a leading end of the cut sheet fed around said platen from being separated from said platen; and (i) control means for receiving a signal from said sensor detecting a cut sheet fed from said hopper and for moving said print head to a position which confronts said ink ribbon replacement recess in said upper sheet guide so that the cut sheet fed from said hopper is fed between said platen and said upper sheet guide without being caught in said recess.

2. An automatic cut-sheet feeder according to claim 1, wherein said sensor detects a leading end of each of the cut sheets before it is turned around said platen.

3. An automatic cut-sheet feeder according to claim 1, wherein said ink ribbon replacement recess defines a clearance between said upper sheet guide and said print head.

4. An automatic cut sheet feeder according to claim 1, further comprising two sheet guides for guiding the cut sheet therebetween, mounted on a guide shaft extending parallel to said platen, one of said sheet guides being axially movable on said guide shaft.

5. An automatic cut-sheet feeder used with a printer, comprising:

(a) a hopper for supporting a stack of cut sheets to be printed;

(b) a stacker for supporting a stack of printed cut sheets;

(c) a platen extending in a longitudinal direction and providing a printing surface against which a cut sheet is fed by feeding the cut sheet from said hopper under and around said platen, said printing surface of said platen having a left platen surface edge and a right platen surface edge opposite said left platen surface edge;

(d) a feed path extending from said hopper to said platen for feeding the cut sheets therethrough;

(e) a sensor disposed along said feed path for detecting the cut sheet fed from said hopper;

(f) a print head mounted on a carriage movable in said longitudinal direction, the carriage having means for replaceably mounting an ink ribbon cartridge thereon, said print head being disposed in confronting relation to said printing surface so as to be reciprocally movable leftward toward said left platen surface edge and rightward toward said right platen surface edge, when viewed in a direction from said print head toward said platen surface, for printing on the cut sheet disposed around said platen;

(g) an upper sheet guide disposed in close proximity to an upper portion of said platen for delivering the printed cut sheet into said stacker, said upper sheet guide having a width in said longitudinal direction, an ink ribbon cartridge replacement recess being provided in said upper sheet guide, said recess being sized to allow replacement of an ink ribbon cartridge on said carriage and said recess having a left recess edge and a right recess edge, when viewed in a direction from said print head toward said platen surface, said recess being made wider than a front sheet guide to facilitate the replacement of the ink ribbon cartridge when the print head is located at said recess, and said recess being provided within a region defined between the center of a maximum width of a cut sheet on which the printer is capable of printing and the center of a minimum width of a cut sheet to facilitate feeding of the sheet onto the platen, the cut sheets each having a width varying from a maximum to a minimum width of the cut sheets on which the printer is capable of printing;

(h) said front sheet guide being mounted on said carriage, said front sheet guide having a width in said longitudinal direction which is less than said width of said upper sheet guide and positioned facing said platen, the front sheet guide being movable together with said print head for preventing a leading end of the cut sheet fed around said platen from being separated from said platen; and (i) control means for receiving a signal from said sensor detecting a cut sheet fed from said hopper and for moving said print head to a position which confronts said ink ribbon replacement recess in said upper sheet guide so that the cut sheet fed from said hopper is fed between said platen and said upper sheet guide without being caught in said recess.

6. An automatic cut-sheet feeder according to claim 5, wherein said sensor detects a leading end of each of the cut sheets before it is turned around said platen.

7. An automatic cut-sheet feeder according to claim 5, wherein said ink ribbon replacement recess defines a clearance between said upper sheet guide and said print head.

8. An automatic cut-sheet feeder according to claim 5, further comprising two sheet guides for guiding the cut sheet therebetween, mounted on a guide shaft extending parallel to said platen, one of said sheet guides being axially movable on said guide shaft.

* * * * *